US010124478B2

(12) United States Patent
Nicholls

(10) Patent No.: US 10,124,478 B2
(45) Date of Patent: Nov. 13, 2018

(54) MULTIPLE-TOOLED HAMMER

(71) Applicant: J. Robert Nicholls, Yakima, WA (US)

(72) Inventor: J. Robert Nicholls, Yakima, WA (US)

( * ) Notice: Subject to any disclaimer, the term of this patent is extended or adjusted under 35 U.S.C. 154(b) by 317 days.

(21) Appl. No.: 15/043,444

(22) Filed: Feb. 12, 2016

(65) Prior Publication Data

US 2016/0243691 A1 Aug. 25, 2016

Related U.S. Application Data

(60) Provisional application No. 62/115,617, filed on Feb. 12, 2015.

(51) Int. Cl.

| | |
|---|---|
| ***B25F 1/00*** | (2006.01) |
| ***B25B 13/50*** | (2006.01) |
| ***B25D 1/04*** | (2006.01) |
| ***B25D 3/00*** | (2006.01) |
| ***B25D 7/00*** | (2006.01) |
| ***B25F 1/04*** | (2006.01) |
| ***B25G 3/12*** | (2006.01) |
| ***B26B 23/00*** | (2006.01) |
| ***B25G 3/14*** | (2006.01) |

(52) U.S. Cl.

CPC ..... *B25F 1/006* (2013.01); *B25B 13/5041* (2013.01); *B25D 1/04* (2013.01); *B25D 3/00* (2013.01); *B25D 7/00* (2013.01); *B25F 1/04* (2013.01); *B25G 3/14* (2013.01); *B26B 23/00* (2013.01); *B25D 2250/111* (2013.01)

(58) Field of Classification Search

CPC ..... B25F 1/006; B25F 1/04; B25B 13/5041; B25D 1/04; B25D 1/045; B25D 3/00; B25D 7/00; B25D 2250/111; B25G 3/14; B25G 3/18; B26B 23/00

See application file for complete search history.

(56) References Cited

U.S. PATENT DOCUMENTS 48,027 A * 5/1865 Park ..... B25F 1/006 7/139
79,346 A * 6/1868 Havely et al. ..... B25F 1/006 7/139
404,001 A * 5/1889 Heacock ..... B25F 1/006 7/139
535,480 A * 3/1895 Bennett et al. ..... B25F 1/006 7/139
611,973 A * 10/1898 Newbrough ..... B25D 1/045 254/26 E
711,408 A * 10/1902 Maggard ..... B25F 1/006 7/139

(Continued)

*Primary Examiner* — David B Thomas
(74) *Attorney, Agent, or Firm* — Svendsen Legal, LLC

(57) ABSTRACT

A multi-tooled hammer with an auxiliary tool mountable to the hammer, the hammer including a hammer-head attached to a handle, the hammer-head including a top-end and the handle including a butt-end. The hammer also has a shank-way defining an internal passage within the hammer, from the top end of the hammer-head to the butt-end of the handle. The auxiliary tool has a tool-head and a tool-shank, with the tool-shank receivable into the shank-way of the hammer, and the tool-head augmented by the hammer in tasks performed by the multi-tooled hammer. The multi-tooled hammer is a versatile, practical, and effective hand-tool for both experienced and unskilled tool users.

7 Claims, 16 Drawing Sheets

(56) References Cited

U.S. PATENT DOCUMENTS

| | | | | | |
|---|---|---|---|---|---|
| 1,453,155 | A * | 4/1923 | Martinez | B25F 1/006 | 7/142 |
| 1,469,472 | A * | 10/1923 | Bangert | B25F 1/006 | 30/94 |
| 2,741,456 | A * | 4/1956 | Williams | B25D 1/00 | 254/26 E |
| 4,409,866 | A | 10/1983 | McBride | | |
| 5,845,354 | A * | 12/1998 | Long | B25B 5/068 | 7/139 |
| 6,827,333 | B1 * | 12/2004 | Lutz | B25D 1/045 | 254/26 E |
| 6,961,973 | B1 * | 11/2005 | Smith | B25B 13/14 | 7/100 |
| 8,424,845 | B2 * | 4/2013 | Cole | B25D 1/045 | 254/22 |
| 9,440,347 | B1 * | 9/2016 | Lopez | B25F 1/006 | |
| 9,636,816 | B1 * | 5/2017 | Lopez | B25F 1/006 | |
| 2008/0264211 | A1 * | 10/2008 | Unda | B25D 1/045 | 81/22 |
| 2016/0001434 | A1 * | 1/2016 | Kania | B25F 1/003 | 7/139 |

* cited by examiner

MULTIPLE-TOOLED HAMMER

TECHNICAL FIELD

This invention pertains to a multiple-tooled hammer apparatus and system, and specifically to a modified hammer with an internal socket for receiving one or more auxiliary tools, the internal socket running within the hammer, and each auxiliary tool having a shank that is receivable into the modified hammer's internal socket.

BACKGROUND OF THE INVENTION

A hammer is a basic hand-tool common to most tool users, which delivers a sudden impact to an object, when swung by the user. Typical uses for hammers include driving nails, shaping metal and breaking apart objects. Hammers can vary in shape, size, and structure, usually depending on their purpose. Usual features of hammers include a hammer-head, most often made of steel, mounted upon a handle that is formed of wood, steel, carbon fiber or fiberglass.

A most common type of hammer is a "claw-hammer," which also includes a claw that extends from the hammer-head. The claw is typically a spiked metal extension of up to about three inches in length, with a slot for gasping a nail or similar item. Usually, the claw is curved to allow the head to lever as it is rotated by pulling on the handle. The size of a claw-hammer is commonly designated by the weight of its hammer-head, which typically ranges from 7 to 32 ounces, or more.

A large collection of hand-tools can be expensive and cumbersome. The broad array of hand-tools required for the wide variety of jobs and needs of the typical handy-person or professional construction contractor, quickly mounts-up into a burdensome pile of equipment. Most tool users simply do without the ideal tool for a given need or job, making due with the tool or tools at hand, often resulting in injury, broken tools and frustration.

The present invention addresses this problem to provide a versatile, practical, and effective multi-tool. With the following disclosure of the present invention, the multi-tool will be understood by reference to the following detailed description, taken in conjunction with the accompanying drawings.

Figure 1:
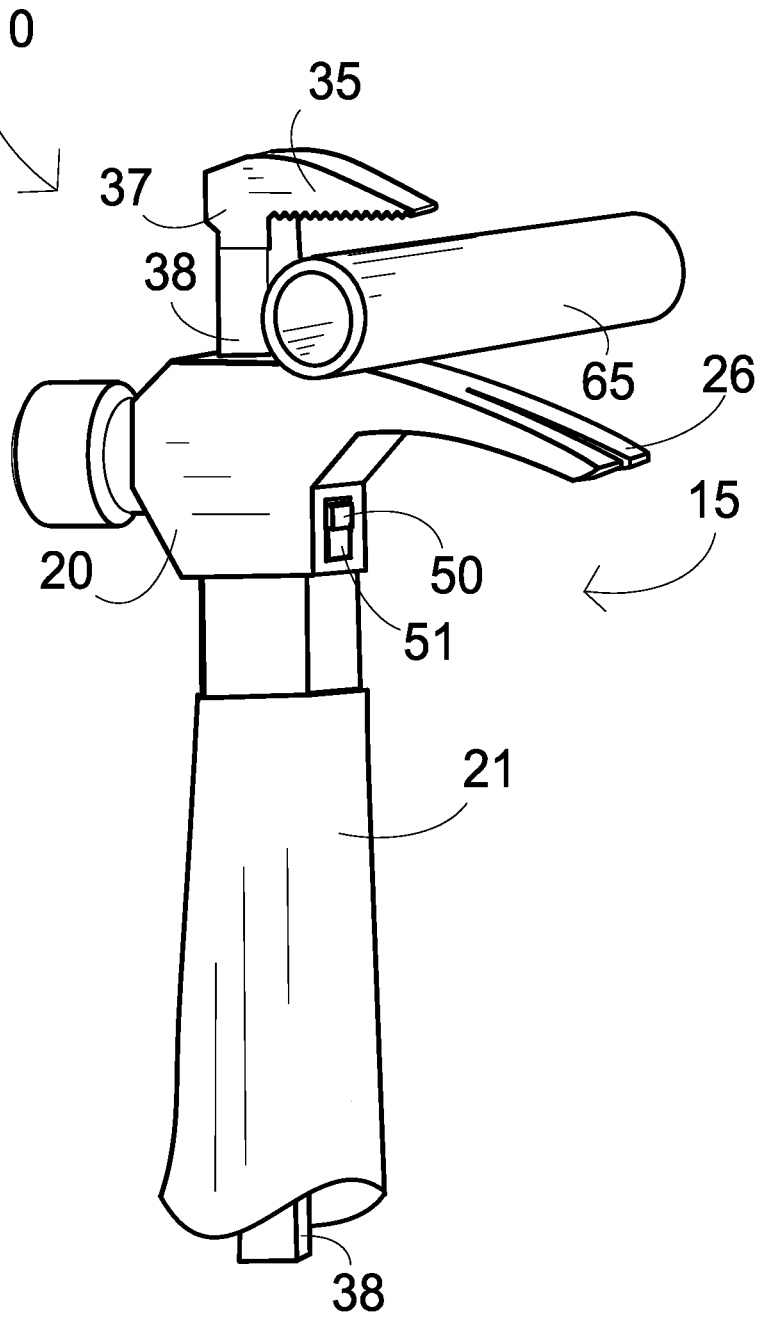
FIG. 1 is a perspective view of a cut-away top portion of a multiple-tooled hammer, according to an embodiment of the invention.

Reference characters included in the above drawings indicate corresponding parts throughout the several views, as discussed herein. The description herein illustrates one preferred embodiment of the invention, in one form, and the description herein is not to be construed as limiting the scope of the invention in any manner. It should be understood that the above listed figures are not necessarily to scale and may include fragmentary views, graphic symbols, diagrammatic or schematic representations, and phantom lines. Details that are not necessary for an understanding of the present invention by one skilled in the technology of the invention, or render other details difficult to perceive, may have been omitted.

DETAILED DESCRIPTION OF SPECIFIC EMBODIMENTS

The present invention is a multiple-tooled hammer apparatus and system, which is a versatile, practical, and effective hand-tool for both experienced and unskilled tool users. The multiple-tooled hammer apparatus and system may be referred to herein as the multiple-tooled hammer, or more simply as the hammer multi-tool. Employing a standard hammer as a core element, the hammer multi-tool is versatile and yet intuitive to use. Both experienced construction contractors and small project handy-persons can enjoy and benefit from using the hammer multi-tool of the present invention.

Figure 2:
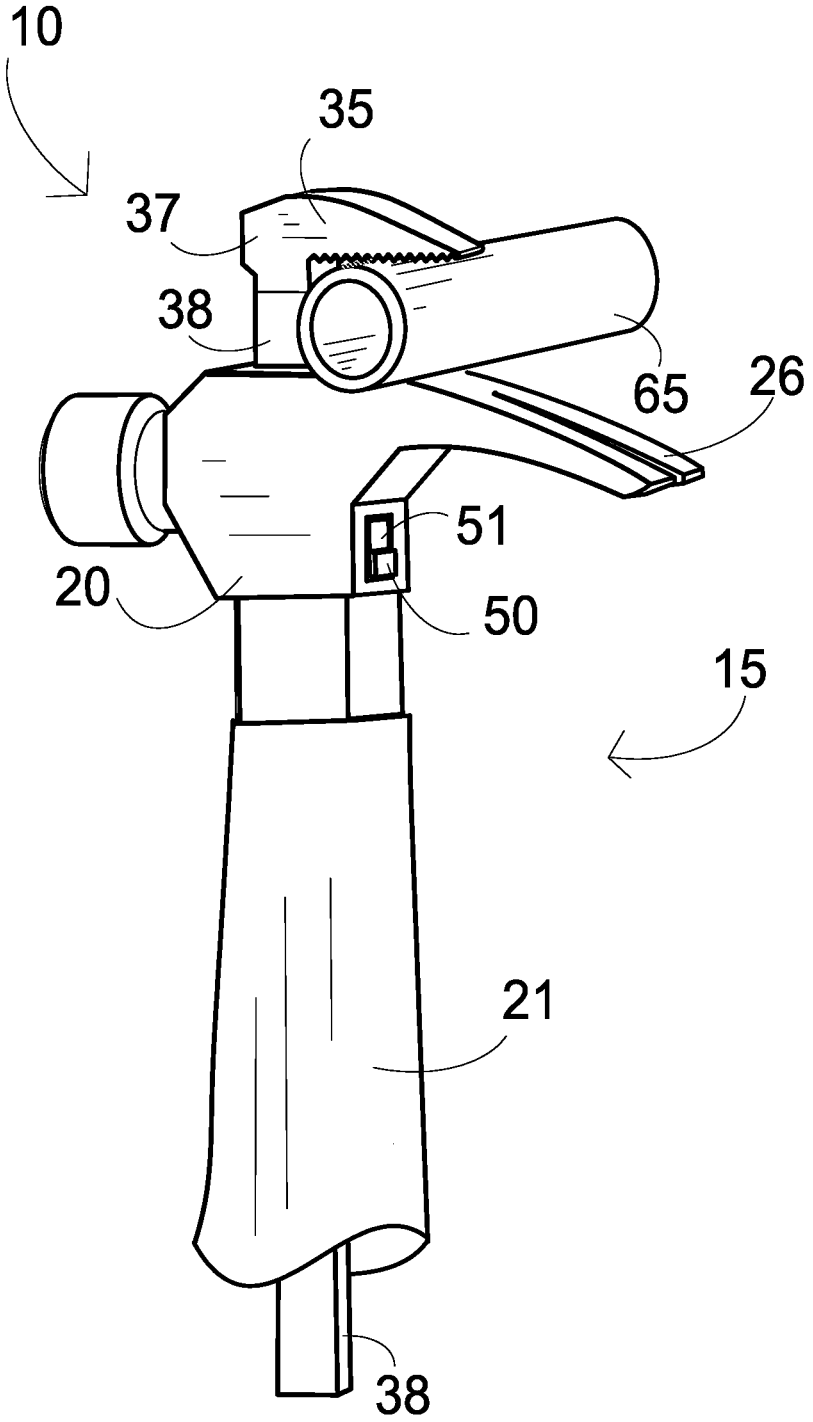
FIG. 2 is a perspective view of a cut-away top portion of a multiple-tooled hammer, according to an embodiment of the invention.
Figure 3:
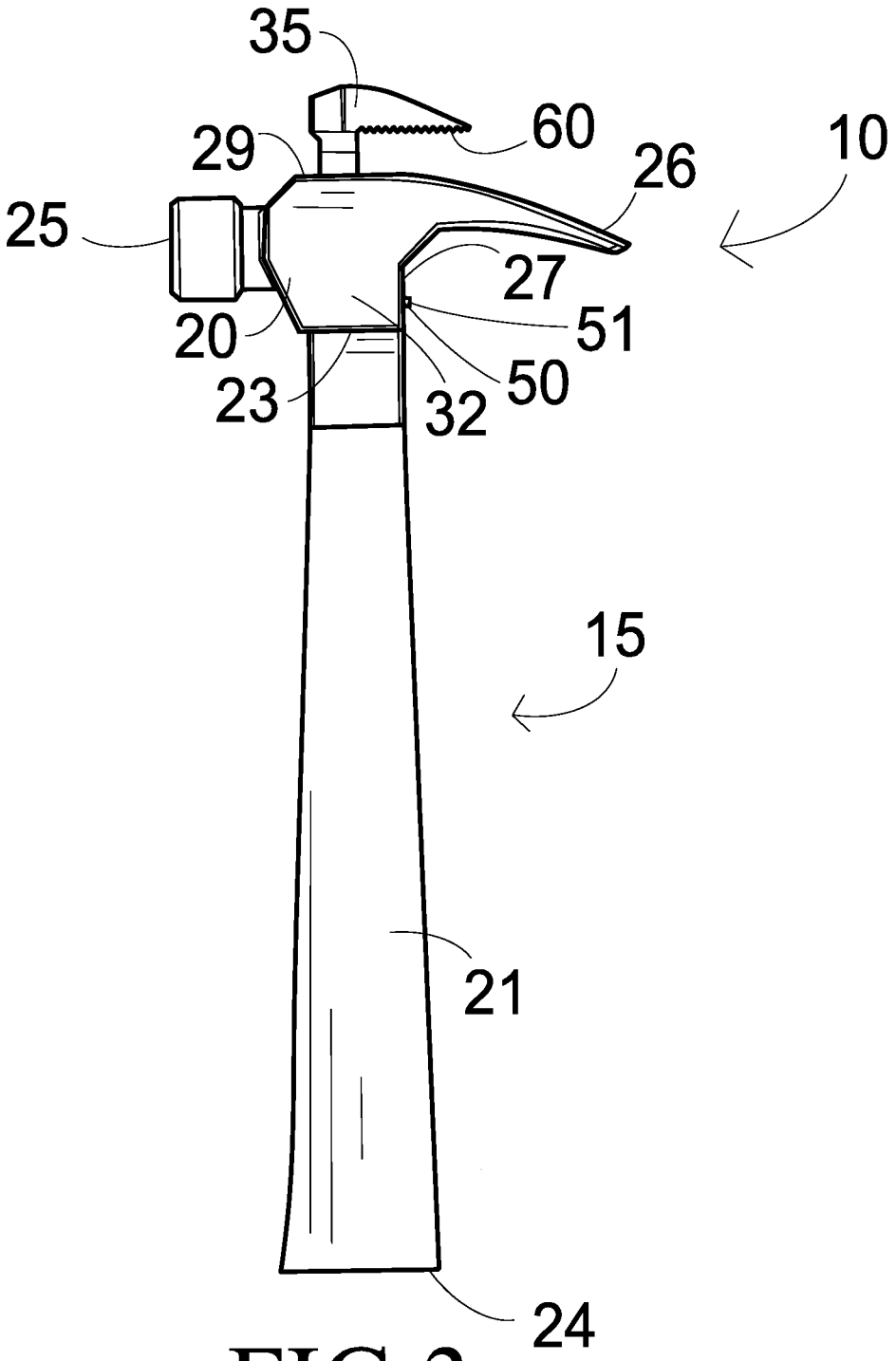
FIG. 3 is side view of a multiple-tooled hammer, according to an embodiment of the invention.

FIGS. 1 through 22 show preferred embodiments of the multiple-tooled hammer apparatus and system 10, again which can be referred to herein, simply as the "hammer multi-tool." FIG. 3 shows a side view of a base-hammer 15, as the core element of the multi-tooled hammer. The base-hammer is a modification of the conventional, claw type of hammer or "claw-hammer," which is employed in the building and construction trades, as well as by homeowners, farmers, and in any other area of handy-work, wherever needed. A key element of the modification is the addition of a shank-way 18 within the base-hammer, as described below.

Figure 4:
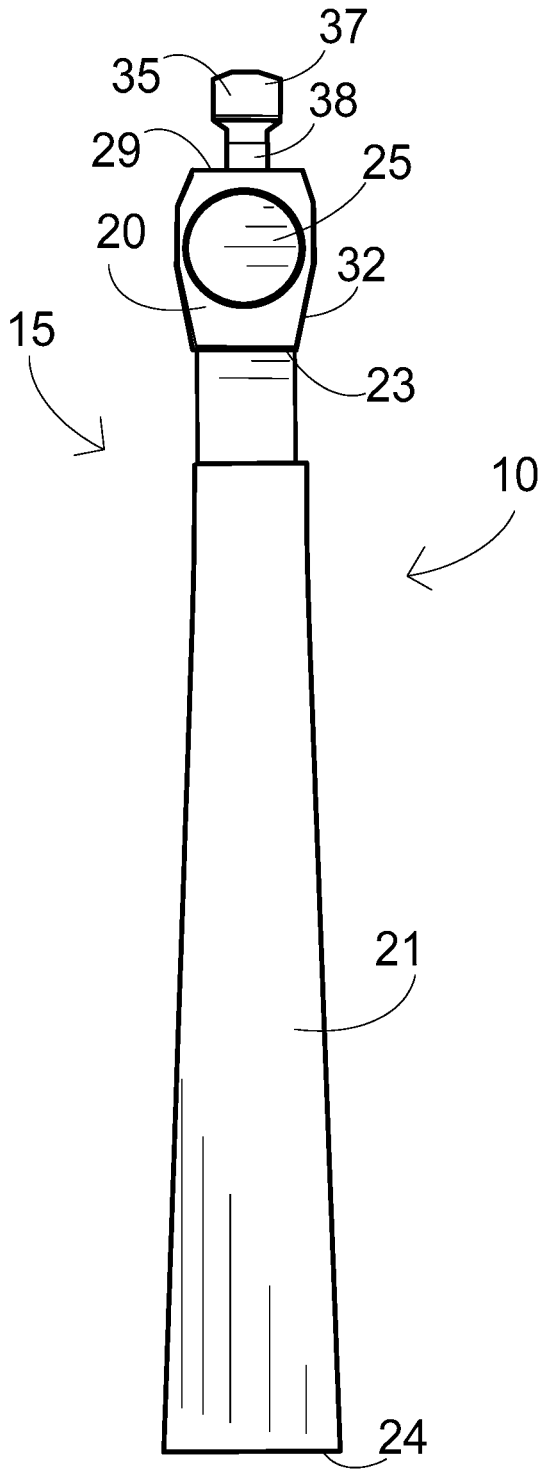
FIG. 4 is a front view of a multiple-tooled hammer, according to an embodiment of the invention.

As detailed in FIGS. 3 and 4, parts of the base-hammer 15 include a hammer-head 20 mounted to a hammer-handle 21, with the hammer-handle extending from a base-end 23 of the hammer-head. Most preferably, the hammer-head is made of metal, and typically a hardened steel, or alternatively titanium. The hammer-handle has a butt-end 24 at the furthest distal point from the hammer-head, opposite the connection of the hammer-handle to the base-end of the hammer-head.

Parts of the hammer-head 20 include a hammer-face 25, which is the object striking or object impacting surface of the base-hammer. The hammer-face can be smooth for most purposes including finish carpentry, or "checked" or "checkered" for easier nailing operations in construction framing tasks. Typically, finishing hammers are smaller as compared to framing hammers, and the present invention is best suited to the base-hammer modeled after either a larger-in-size finishing hammer, or a smaller-in-size framing hammer, and preferably with a hammer-head weight of approximately 16 to 28 ounces. However, either lighter or heavier in weight hammer-heads could be used for the present invention.

The hammer-face 25 extends from the hammer-head 20 at approximately a 90-degree angle from the hammer-handle, as shown in FIGS. 3 and 4. Most preferably, the base-hammer has features of the "claw-hammer," which is the most common type of conventional hammer.

Figure 12:
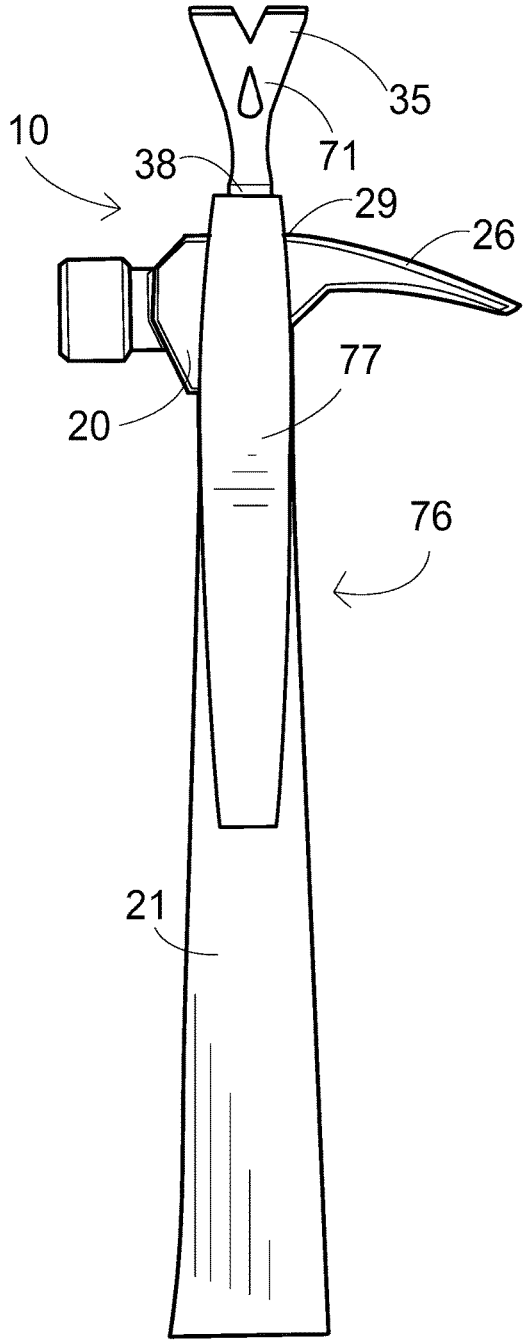
FIG. 12 is side view of a multiple-tooled hammer, according to an embodiment of the invention.
Figure 13:
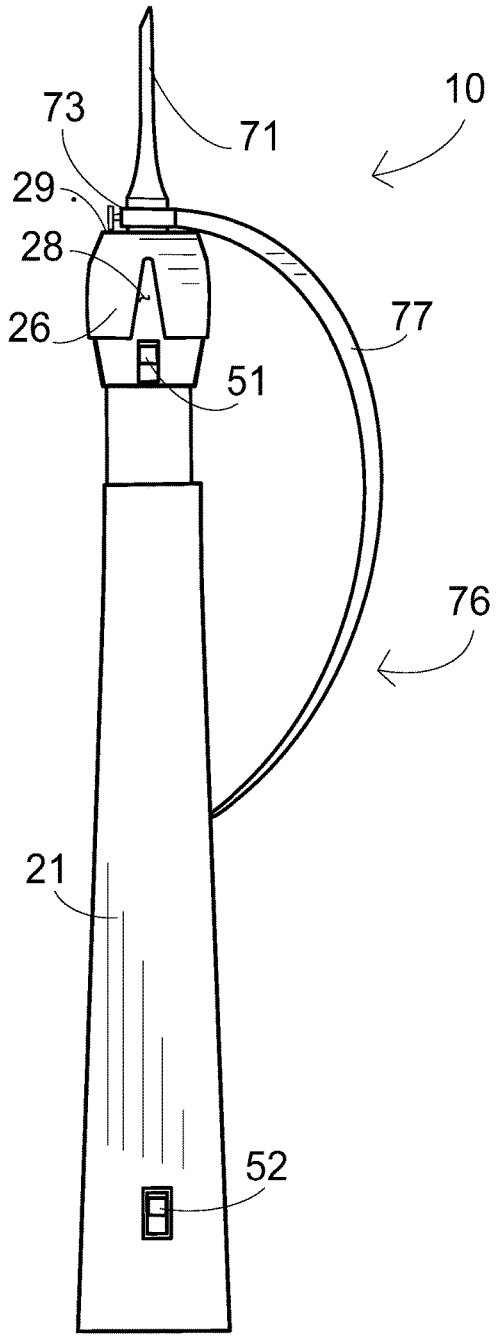
FIG. 13 is a back view of a multiple-tooled hammer held by a user, according to an embodiment of the invention.

The hammer-head 20 of the base-hammer 15 also includes a hammer-claw 26 that extends from the hammer-head at a hammer-backside 27, which is the side of the base-hammer opposite from the hammer-face 25. Like the hammer-head, the hammer-claw extends at approximately a 90-degree angle from the hammer-handle 21. The hammer-claw is typically a spiked metal extension up to approximately three inches in length, with a claw-slot 28 for gasping a nail or similar object, as shown in FIG. 13. Preferably, the hammer-claw smoothly transitions to the hammer-head a top-end 29 of the hammer-head, as shown in FIGS. 12 and 13. The top-end is an opposite on the hammer-head to the base-end 23, as shown in FIGS. 3 and 4. The top-end can also be closely proximate to the termination of the hammer-handle, especially if the handle is non-integral to the hammer-head and inserted into the hammer-head at the base-end. Usually, the hammer-claw is curved as shown in FIG. 13, to allow the hammer-head to leverage the hammer-claw as the hammer-head rotates about the top-end.

Between the hammer-face 25 and the hammer backside 27 of the hammer-head 20, the hammer-head has a hammer-cheek 32, as shown in FIG. 3. There are two flat hammer-cheeks on the conventional hammer-head of the typical base hammer 15, one each on opposing sides of the hammer-head.

Figure 5:
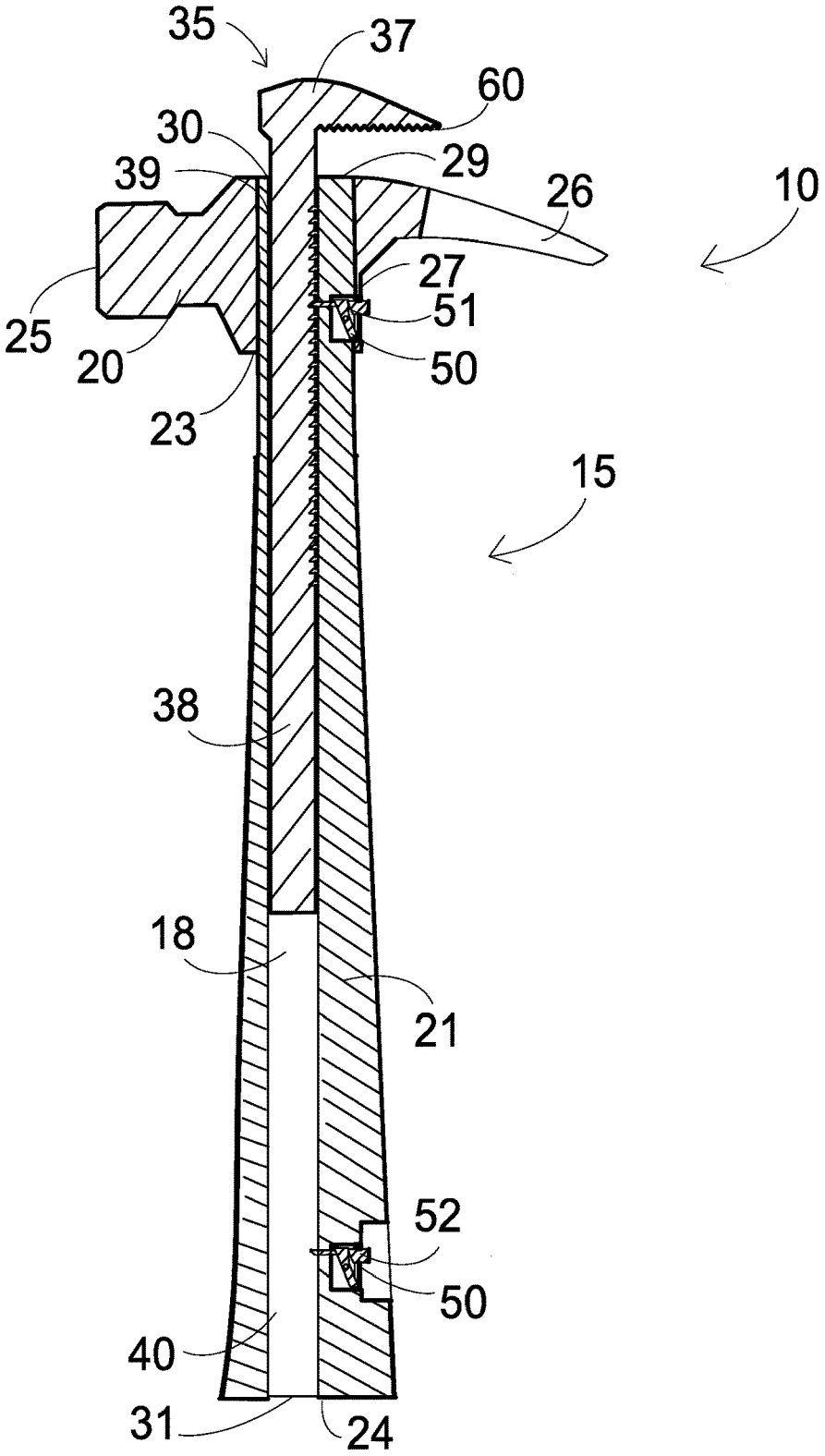
FIG. 5 is sectioned side view of a multiple-tooled hammer, according to an embodiment of the invention.
Figure 6:
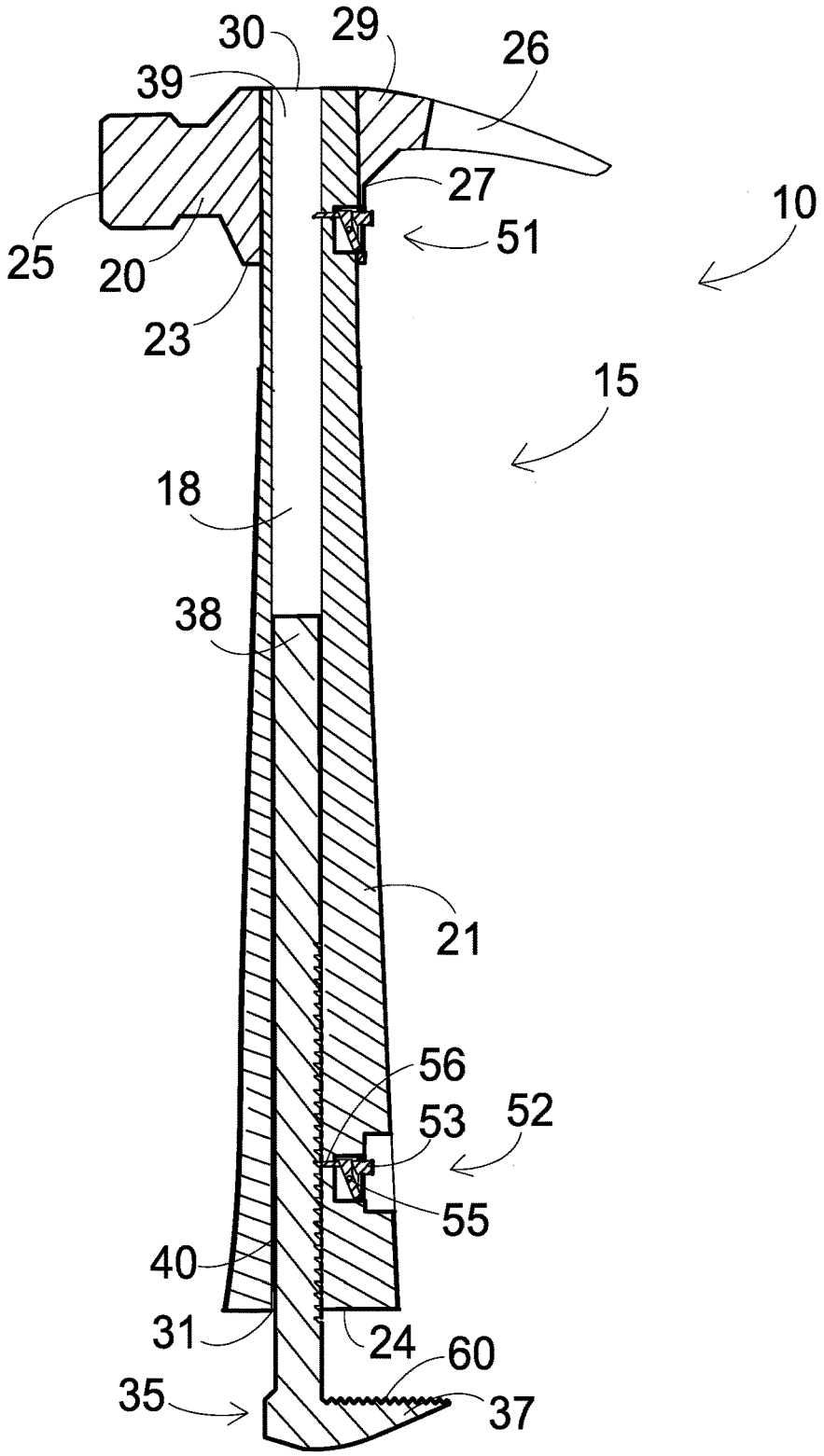
FIG. 6 is a sectioned side view of a top portion of a multiple-tooled hammer, according to an embodiment of the invention.

As noted above, a key element of the hammer multi-tool 10 is the shank-way 18 within the base-hammer 15. The shank-way defines an internal passage within the base-hammer, from the top-end 29 of the hammer-head to the butt-end 24 of the hammer-handle. The shank-way is preferably a metal tube or pipe within the base-hammer and most preferably square in cross-section, although other cross-sectional shapes are considered, such as hexagonal or octagonal, and could be any reasonable shape in the cross section, including round, oval or triangular. As shown in FIGS. 5 and 6, the shank-way is open at the top-end of the hammer-head, which functions as a head receiver 30. Additionally, as shown in FIG. 5, the shank-way is open at the butt-end of the handle, which functions as a handle-receiver 31. The shank-way can be incorporated into any desired hammer-handle, which can be made of wood or any alternative materials as selectable by persons skilled in high impact handle manufacture. Alternative materials for forming the hammer-handle may include steel, fiberglass or carbon fiber. Also in the alternative, the entire base-hammer may be formed from a single piece of forged heat-treated steel, where the head and handle are integral elements, and most preferably with the hammer-handle clad in a rubber-like or plastic grip material.

Figure 7:
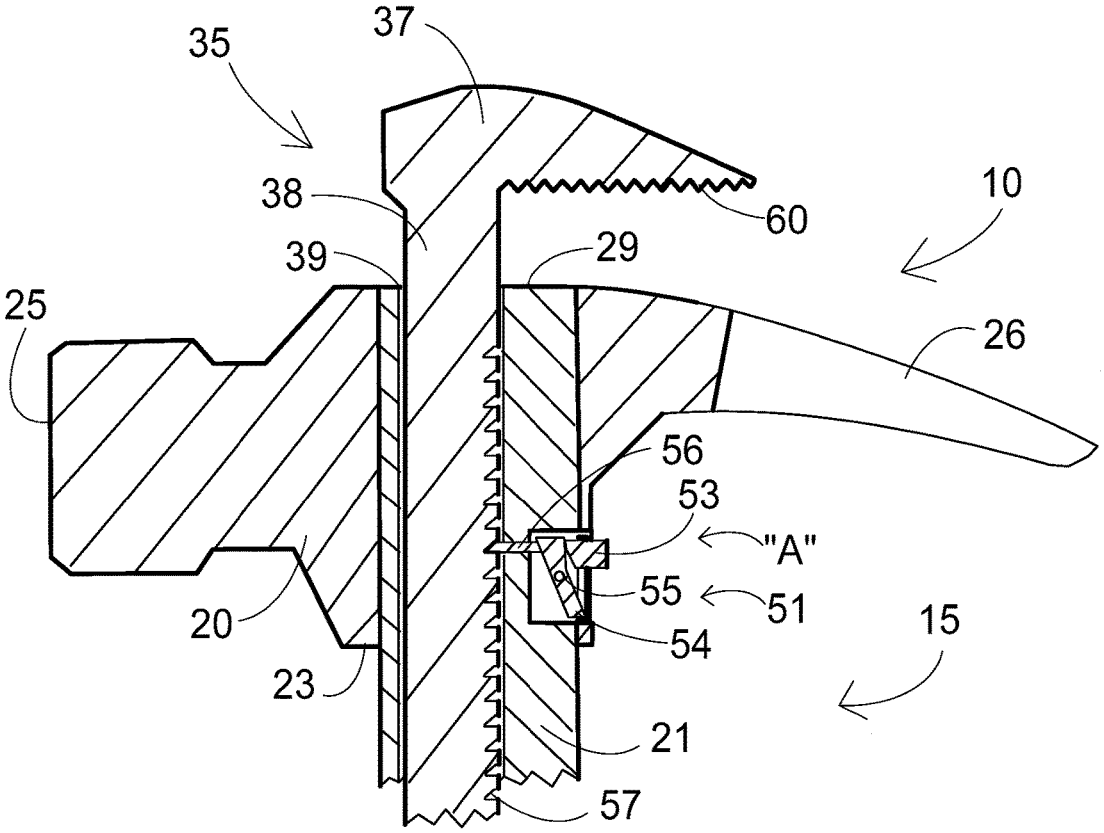
FIG. 7 is a sectioned side view of a top portion of a multiple-tooled hammer, according to an embodiment of the invention.
Figure 8:
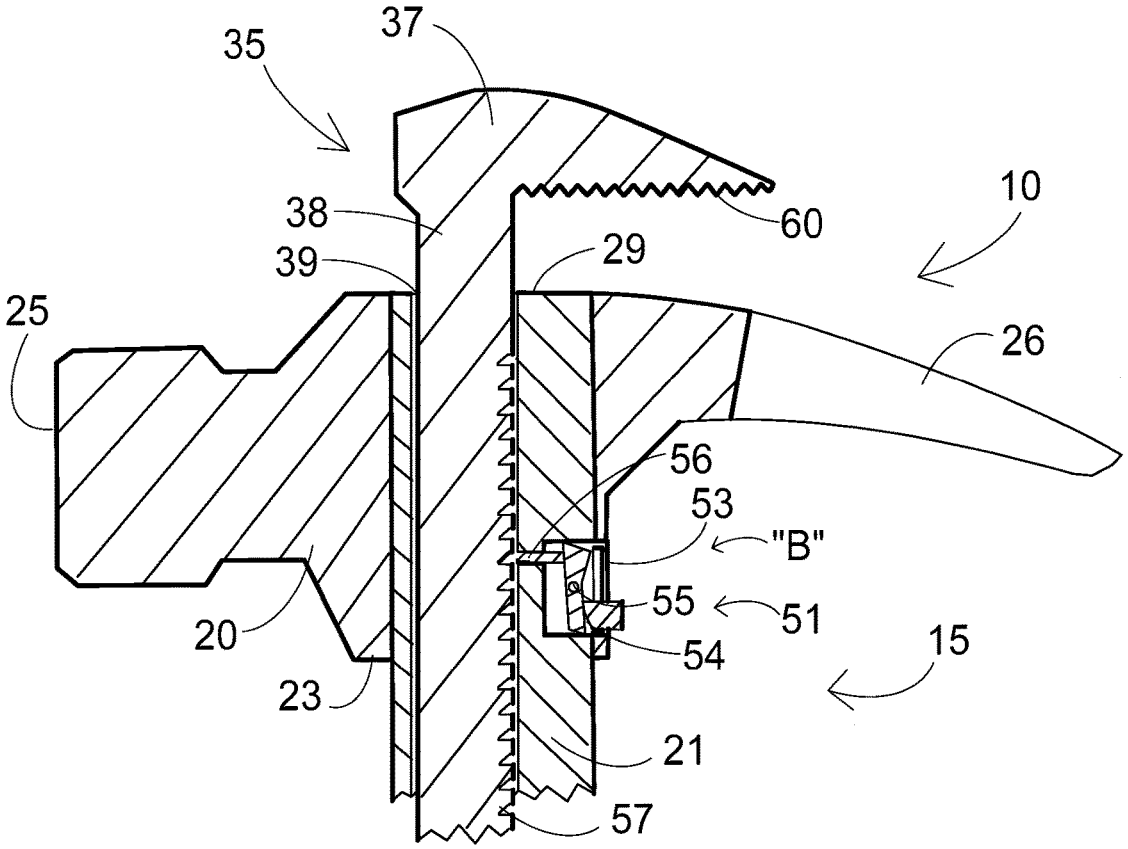
FIG. 8 is a sectioned side view of a top portion of a multiple-tooled hammer, according to an embodiment of the invention.

An auxiliary-tool 35 is mountable into the shank-way 18 within the base-hammer 15 of the hammer multi-tool 10, As shown in FIG. 6. The auxiliary tool has a tool-head 37 opposite a tool-shank 38. The tool shank is preferably made of a hardened steel and sized to precisely fit into the shank-way, and has the same cross-sectional shape as the shank-way. The tool-shank is receivable into a head shank-way 39, at the head-receiver 30, which is the shank-way beginning at the head-receiver 32, located proximate to the top-end 29 of the hammer-head 20, as shown in FIGS. 7 and 8.

Figure 9:
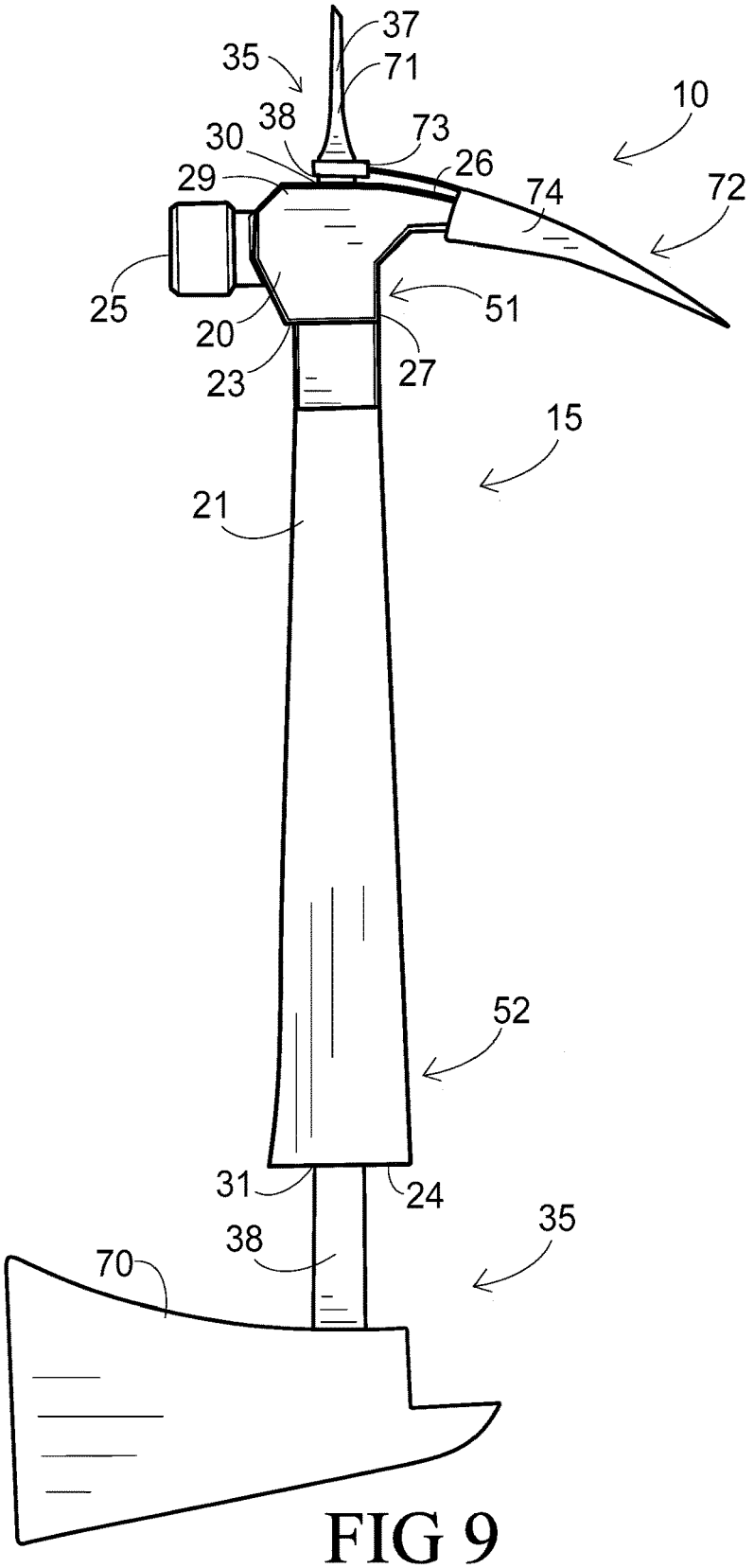
FIG. 9 is side view of a multiple-tooled hammer, according to an embodiment of the invention.
Figure 10:
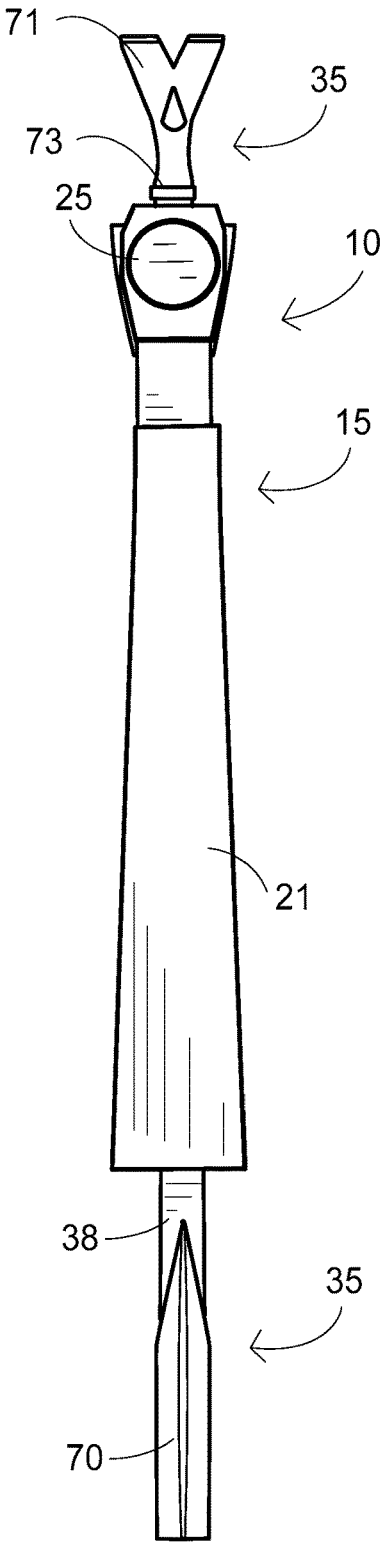
FIG. 10 is front view of a top portion of a multiple-tooled hammer, according to an embodiment of the invention.
Figure 11:
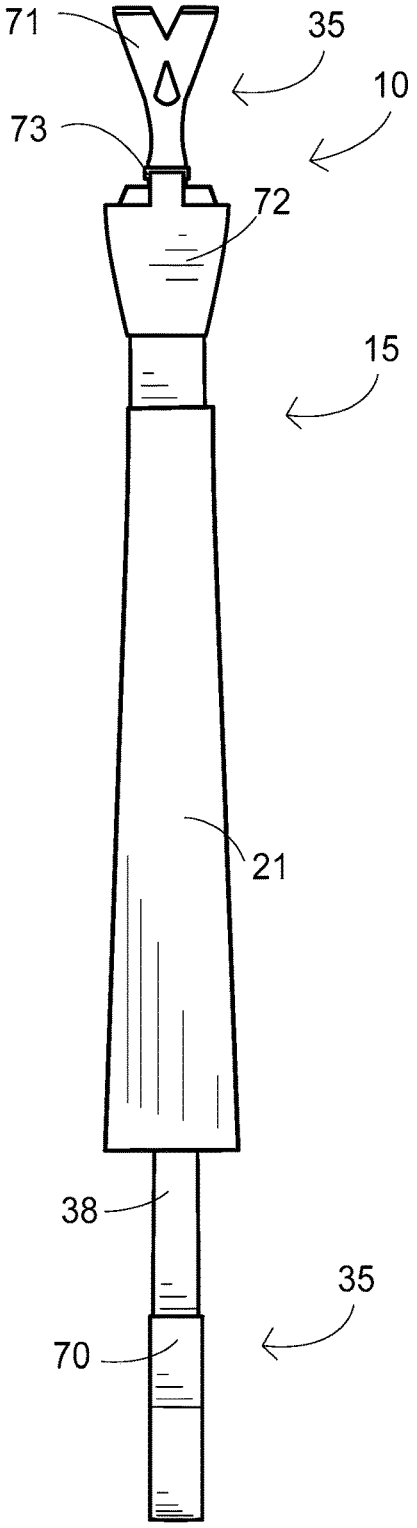
FIG. 11 is back view of a multiple-tooled hammer, according to an embodiment of the invention.

In addition to the head shank-way 39, the tool-shank 38 may be receivable into a handle shank-way 40, which is the shank-way beginning at the handle receiver 31, located proximate to the butt-end 24 of the hammer-handle 21. With the tool-shank received into the shank-way, the tool-head 37 of the auxiliary-tool 35 extends from the base-hammer, either from the head-shank-way or from the handle shank-way or both, if two auxiliary-tools are used, as shown in FIGS. 9 through 11.

The auxiliary-tool 35 is a versatile attachment to the base-hammer 15 and may the tool-head 37 may include a wide variety of useful shapes and features to aid in tasks utilizing the hammer multi-tool 10, as detailed and listed later herein and shown in FIGS. 1 through 14. Most importantly, the tool-head augments the base-hammer in tasks performed by the hammer multi-tool.

Preferably, to keep the tool-shank 38 affixed within the shank-way 18 of the base-hammer, the hammer multi-tool 10 includes a shank-lock 50. As shown in FIGS. 5 and 6, the shank-lock may be a head shank-lock 51. The head shank-lock is operable either to lock the tool-shank within the shank-way, or release the tool-shank, so that it may slide freely within the shank-way or be removed from the shank-way. In a preferred embodiment of the hammer multi-tool, the head shank-lock is located proximate to the hammer-claw, on the hammer-backside 27 of the hammer-head 20.

In addition to the head shank-lock 51, a handle shank-lock 52 can be used in the base-hammer. Like the head shank-lock, the handle shank-lock can also retain and affix the tool-shank 38 within the shank-way 18 of the base-hammer for the hammer multi-tool 10, as shown in FIG. 2. The handle shank-lock is operable either to lock the tool-shank within the shank-way, as shown in a locked position "A" in FIG. 7, or to release the tool-shank as shown in an unlocked position "B" in FIG. 8, so that it may slide freely within the shank-way or be removed from the shank-way.

In a preferred embodiment of the hammer multi-tool 10, the handle shank-lock 52 is located proximate to the butt-end 24 of the hammer-handle 21. Preferably, the handle shank-lock is located on the same side of the hammer-handle as the hammer-backside 27 of the hammer-head 20. Most preferably, the handle shank-lock is located on the base hammer 15 at approximately the same distance from the butt-end of the hammer-handle as the head shank-lock 51 is located from the top-end 29 of the hammer-head 20, as shown in FIGS. 5, 6, 11, and 13.

Without engaging the shank-lock 50, the hammer multi-tool 10 can be used as a simple impact hammer. As an example, with the auxiliary tool 35 selected as the wrench-jaw 60 and with the head shank-lock 51 in the unlocked position "B" as shown in FIG. 8, the auxiliary tool can slide freely in the shank-way 18 the base-hammer 15. The tool-head 37 of this free sliding auxiliary tool can rest against an object while the base-hammer is repeatedly driven into and away from the object, with the weight of the base-hammer impacting against the object.

The mechanism of the head shank-lock 51, and the handle shank-lock 52, can include a slider-switch 53 that forces a slider-arm 54 to rotate about a lock-pivot 55, which pivots to extend or retract a lock-pin 56 into a lock-socket 57 within the took-shank 38. Most preferably, the tool-shank includes a multiple of lock-sockets along the tool-shank to allow the auxiliary tool to be set at any desired extension form the shank-way 18. Additionally, a multiple of lock-pins may extend from the slider-arm to engage and lock the tool-shank, and provide a more secure and unmovable locking of the tool-shank within the shank-way.

The shank-lock 50 may be any mechanism that securely and easily locks the tool-shank 38 within the shank-way 18 of the base hammer 15. As an example, the shank-lock may be configured as taught in U.S. Pat. No. 4,409,866 to McBride, or an equivalent mechanism. In the preferred embodiment of the hammer multi-tool, the shank-lock is engaged or disengage by the user of the hammer multi-tool 10, and preferably by the action of the users thumb against the slider switch 53.

Figures 15, 16, 17, 18:
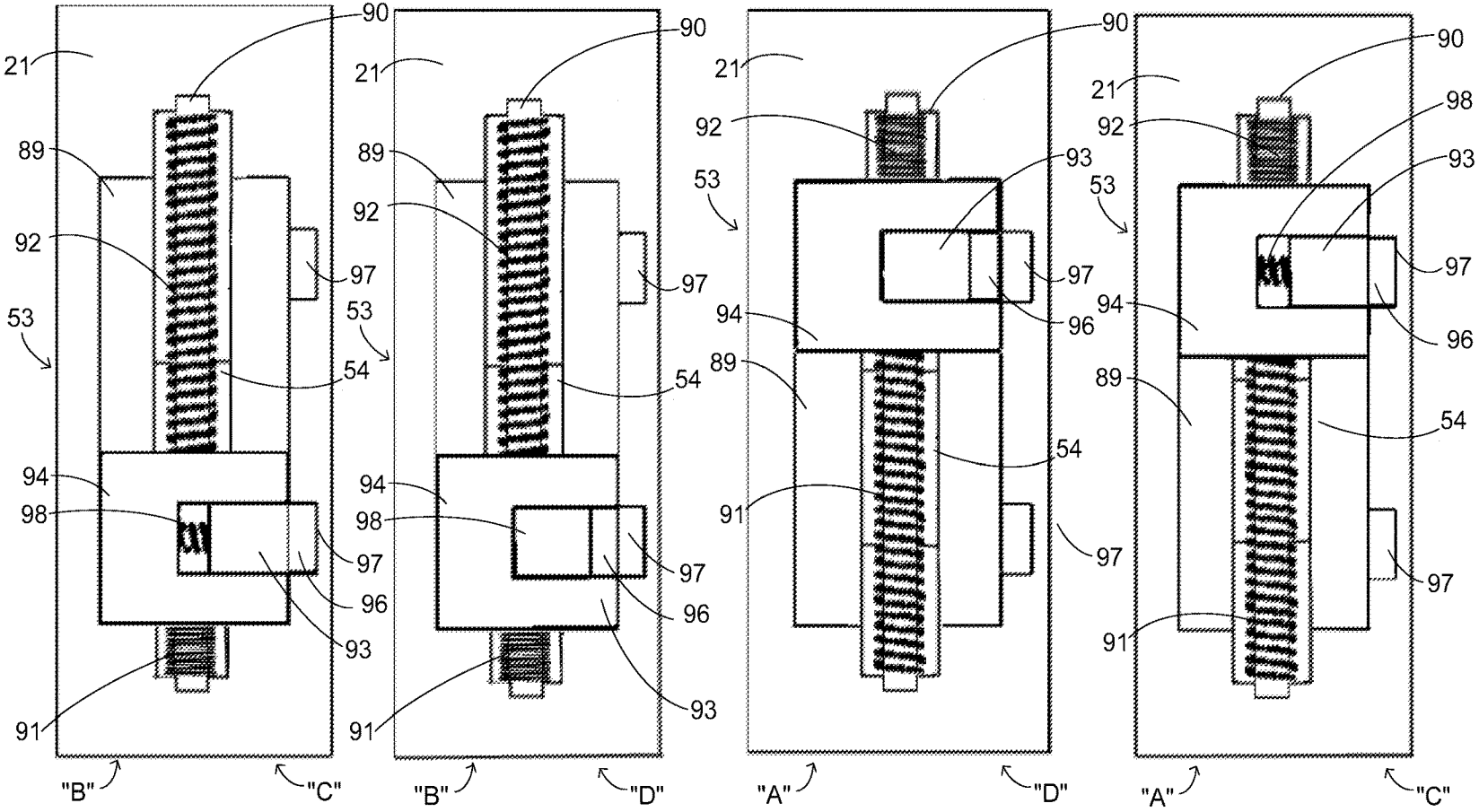
FIG. 15 is a side view of a portion of a multiple-tooled hammer, according to an embodiment of the invention.
FIG. 16 is a side view of a portion of a multiple-tooled hammer, according to an embodiment of the invention.
FIG. 17 is a side view of a portion of a multiple-tooled hammer, according to an embodiment of the invention.
FIG. 18 is a side view of a portion of a multiple-tooled hammer, according to an embodiment of the invention.

An alternative preferred embodiment of the shank-lock 50, for use with the hammer multi-tool 10 is shown in FIGS. 15 through 22, with the shank-lock including a slide-bar 90 positioned beneath the slider-switch 53, and within a slider-socket 89. The slide-bar runs inside a lock-spring 91 and an unlock-spring 92. As shown in FIGS. 15 through 18, the lock spring and unlock-spring are placed on opposing sides of the slider switch. The lock-spring extends to force the slider-switch to the locked position "A" as shown in FIGS. 15 and 16, and the unlock-spring extends to force the slider-switch to the unlocked position "B", as shown in FIGS. 17 and 18.

Figure 19:
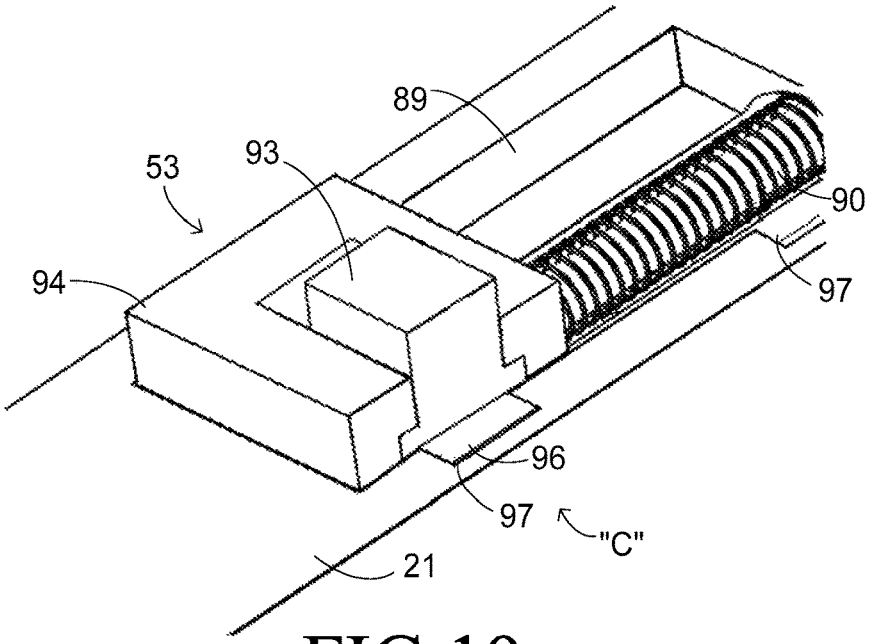
FIG. 19 is a perspective view of a cut-away top portion of a hammer-handle and shank-lock with a slider-switch in an engaged position "C", according to an embodiment of the invention.
Figure 20:
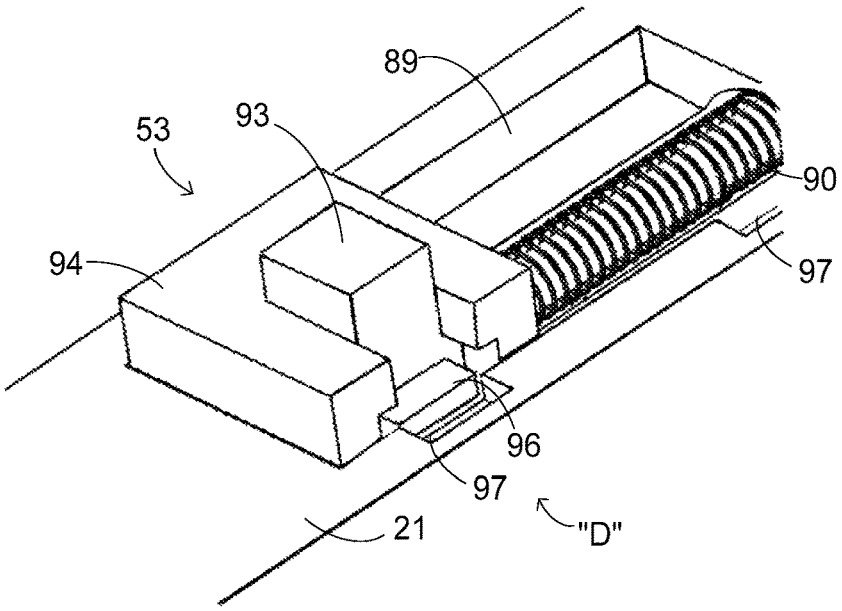
FIG. 20 is a perspective view of a cut-away top portion of a hammer-handle and shank-lock with a slider switch button in a disengaged position "D", according to an embodiment of the invention.

In this alternative preferred embodiment of the shank-lock 50, the slider-switch 53 includes a switch-button 93 received within a switch-yoke 94, as shown in FIGS. 19 and 20. FIG. 19 shows the switch-button in an engaged position "C" within the switch-yoke, and FIG. 20 shows the switch-button in a disengaged position "D" within the switch-yoke. The switch-button includes a switch-tab 96 that is received into a switch-seat 97, to engage the shank-lock in place and prevent the slider-switch yoke from traveling along the slider-socket 89. Most preferably, the switch seat is formed within the slider-socket, as shown in FIG. 16. Additionally, the switch-button is held by default in the engaged position with a button-spring 98, as shown in FIGS. 15 and 18.

The button-spring 98 compresses when the switch-button 93 is manually moved to the disengaged position "D" as shown in FIGS. 16 and 17, and automatically extends to the engaged position "C" when the switch-tab 96 is able to seat within or mate to the switch-seat 97, as shown in FIGS. 15 and 18. To slide the slider-switch from the locked position "A" to the unlocked position "B", the switch-button is moved to from the engaged position "C" as shown in FIG. 15, to the disengaged position "D" as shown in FIG. 16. Then the slider-switch then can slide within the slider-socket 89 to the unlocked position as shown in FIG. 17, where the slider-switch can move from the unlocked position to the locked position as shown in FIG. 18.

Figure 22:
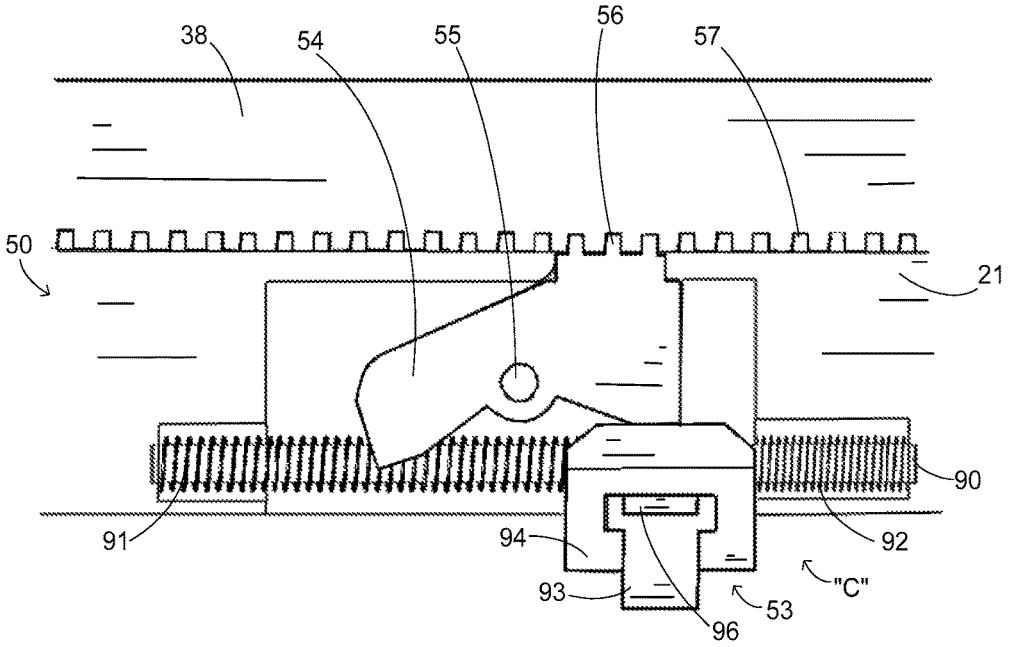
FIG. 22 is a side view of a portion of a cut-away top portion of a hammer-handle and shank-lock with a slider switch button in an engaged position "C", according to an embodiment of the invention.

With the shank-lock 50 in the unlocked position "B" shown in FIG. 22, the switch-button 93 of the slider-switch 53 forces the slider-arm 54 to rotate about the lock-pivot 55, which pivots to extend the lock-pin 56 into the lock-socket 57, within the took-shank 38. With the multiple of lock-sockets along the tool-shank, the auxiliary tool can be set at any desired extension form the shank-way 18.

Figure 21:
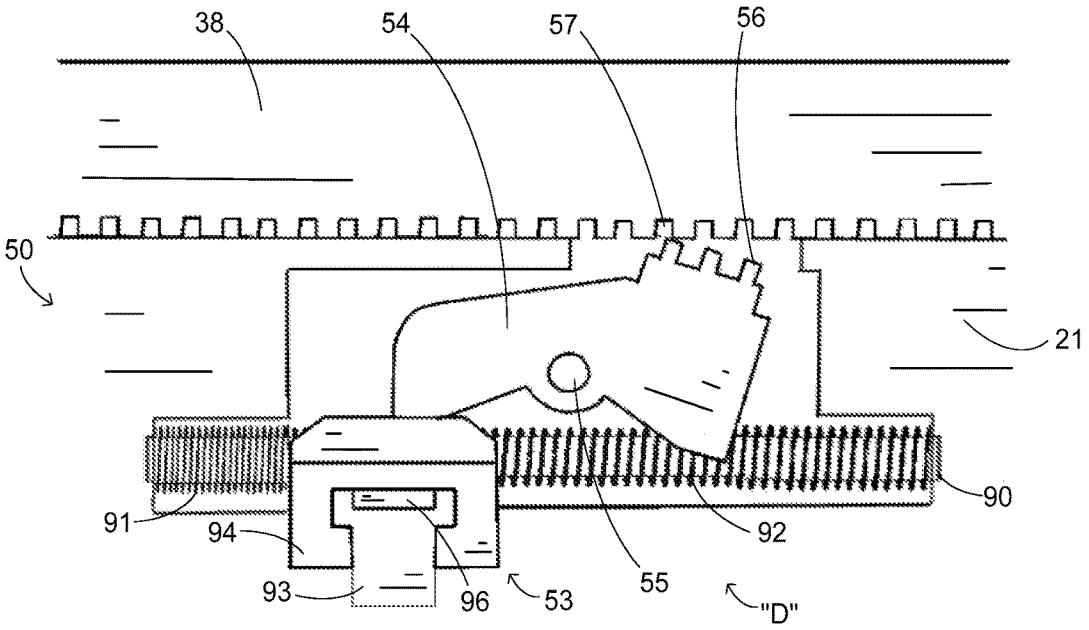
FIG. 21 is a side view of a portion of a cut-away top portion of a hammer-handle and shank-lock with a slider switch button in a disengaged position "D", according to an embodiment of the invention.

Most preferably, three lock-pins 56 extend from the slider-arm 54 to engage three lock-sockets 57 and lock the tool-shank 38 in the locked position "A", as shown in FIG. 21, providing a secure and unmovable locking of the tool-shank within the shank-way 18.

The tool-shank 38 of the auxiliary tool 35 must be held securely with the shank-way, to provide a reliable and fixed positioning of the auxiliary tool. For example, as shown in FIG. 1, the tool-shank 38 of a wrench-jaw 60 can be inserted into the head receiver 30 and received into the head shank-way. The wrench jaw has a jaw that can be clamped onto an object 65, such as a pipe, as shown in FIG. 2. With the wrench-jaw, lockable with the shank-lock 50, the base-hammer 15 is transformed into the hammer multi-tool 10.

Another auxiliary tool 35 is shown in FIGS. 9 through 11, and includes an axe 70 with a chisel 71. The axe may be placed into the handle receiver 31, with the chisel placed into the head receiver 30. The chisel may be a specific variety of chisel describable as a "cats-paw," and include nail pulling features. An additional attachment of the base-hammer 15 may include a claw-pick 72. The claw-pick transforms the hammer-claw 26 of the hammer-head 20 into a pick or a chisel. As shown in FIGS. 10 and 11, the claw-pick includes a shank-eye 73 that receives the tool-shank, and a claw-pouch 74 that is placed over the hammer-claw. With the auxiliary tool, such as the chisel, threaded through the shank-eye after the claw-pouch caps the hammer-claw, the claw-pick extends and modifies the hammer-claw into a pick that can function like the pick of a conventional ice-axe.

Additionally, the combination of axe 70, chisel 71 and claw-pick 72, as shown in FIGS. 9 through 11, would be especially useful for fire-fighters, truckers or emergency responders, as a light-in-weight and versatile tool. Other, additional variations for the auxiliary tool 35 could include scrappers, a tire iron, a jack handle, a shovel, a shingle axe, or a wrecking bar. Still additional variations for the auxiliary tool include an ice pick and a rock chipper, a clamp, scissors or snips, a razor blade holding scrapper, pliers, a variety of saws or knives, including a pipe saw, a tree saw, a machete, or a sheet-rock knife. Additional utilitarian auxiliary tools could include a broom, a wire brush, a socket wrench, a file, a pipe bender, a meat hook, a dog stake, a scrubber a lid opener, or a clamp. Cord winders and a crank-able spool are also considered as potential auxiliary tools.

As shown in FIGS. 12 and 13, instead of covering the hammer-claw, the claw-pick 72 could be modified as a side-roller 76. Similar to the claw-pick, the side-roller would include a shank-eye 73, through which the tool-shank 38 would thread. However, for this auxiliary tool 35, the shank-eye fits at an approximate 90-degree angle relative to the preferred hammer-claw 26 enclosing claw-pick and instead hang over the hammer-cheek 32 of the hammer-head 20 and extend down the hammer-handle 21. The side-roller has a roller-bar 77 that acts as a rolling fulcrum, when the hammer-handle of the base hammer 15 is pulled or leveraged to engage the chisel against a worked article or object. With the side-roller, the leverage of the base-hammer 15 is increased considerably. The hammer multi-tool 10 having the combination of the chisel and the side-roller is very useful in scraping and prying operations or tasks.

Figure 14:
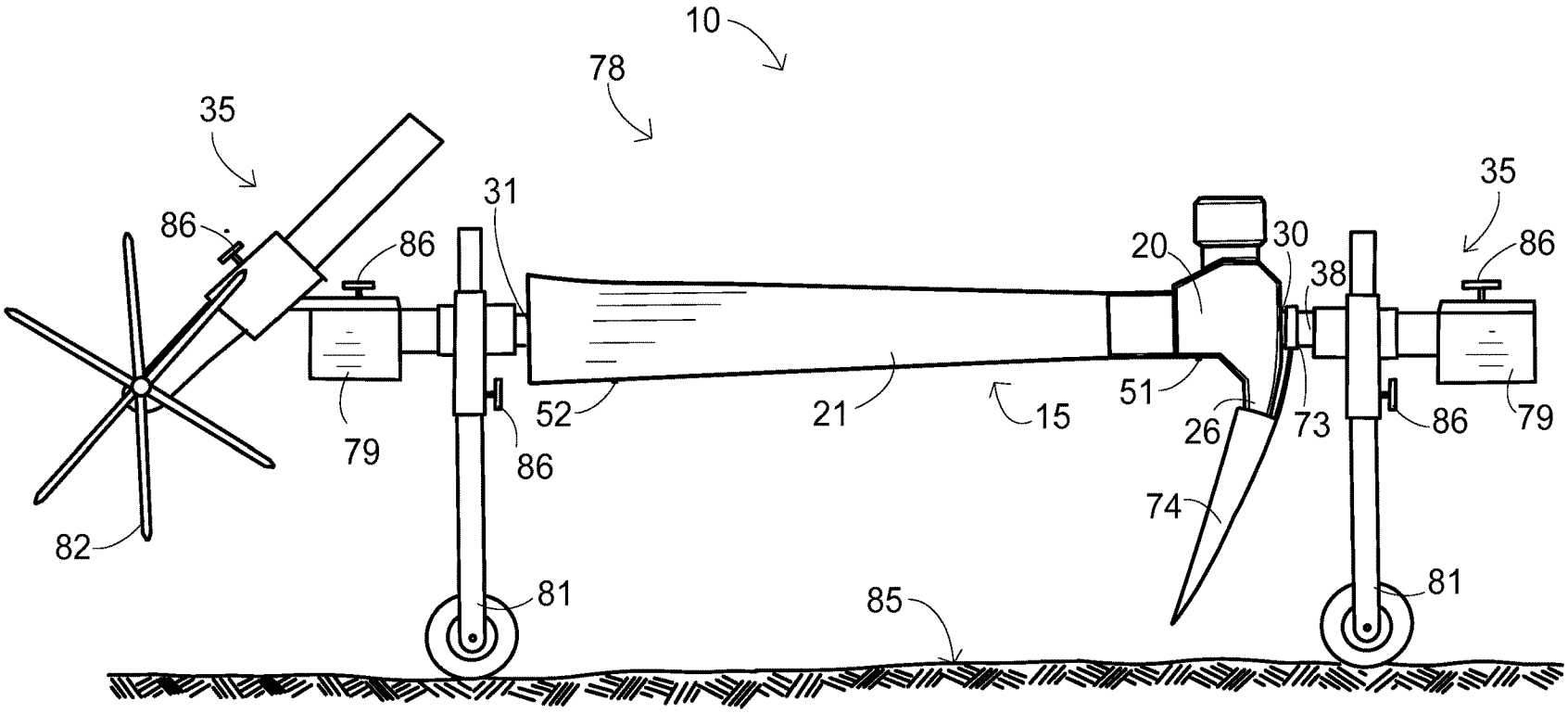
FIG. 14 is a side view of a multiple-tooled hammer, according to an embodiment of the invention.

With further modifications, the auxiliary tool 35 could include features of a hand-truck, or alternatively a garden hand-tractor 78. The garden hand-tractor is shown in FIG. 14, and includes a pair of end-receivers 79, a first inserted into the head-receiver 30 and a second into the handle-receiver 31. The end receivers include extension sockets that can in turn receive additional extension tools, such as traveling wheels 81 and for a tined cultivator 82, as also shown in FIG. 14. Additionally, the claw-pick 72 can be added, to act as a hoe or spade, to plow into a ground surface 85. The traveling wheel can be adjusted up and down with an adjustment knob 86 that allows the height of the base-hammer 15 to be raised or lowered, relative to the ground surface.

Again, the hammer multi-tool 10 provide a versatile, practical, and effective multi-tool. The above examples are but a few of the many alternative uses conceivable for the multiple-tooled hammer apparatus and system as a versatile, practical, and effective hand-tool for both experienced construction contractors and small project handy-persons.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

Of note, the terms "substantially," "proximate to" and "approximately" are employed herein throughout, including this detailed description and the attached claims, with the understanding that is denotes a level of exactitude or equivalence in amount or location commensurate with the skill and precision typical for the particular field of endeavor, as applicable.

The following is claimed:

1. A multi-tooled hammer apparatus comprising:

a base-hammer having a hammer-head attached to a hammer-handle, the hammer-head including a top-end and the hammer-handle including a butt-end, and the base-hammer including a shank-way, the shank-way defining an internal passage within the base-hammer from the top end of the hammer-head to the butt-end of the hammer-handle;

an auxiliary tool mountable to the base-hammer, the auxiliary tool having a tool-head and a tool-shank, the tool-shank receivable into the shank-way of the base hammer;

the tool-head augmented by the hammer-head in a task performed by the multi-tooled hammer apparatus;

a shank-lock, the shank-lock operable to lock the shank within the shank-way of the multi-tooled hammer; and a head receiver included proximate to the top-end of the hammer-head, the tool-shank of the auxiliary tool insertable into the shank-head receiver at the head receiver.

2. The multi-tooled hammer apparatus of claim 1, wherein:

the shank-lock is a head shank-lock, the hammer head having a base-end opposite the top-end of the hammer head, the head shank-lock located proximate to the base-end of the hammer-head and the head shank-lock operable to lock the shank of the auxiliary tool inserted through the head receiver into the shank-way of the multi-tooled hammer.

3. The multi-tooled hammer apparatus of claim 2, wherein:

the shank-lock is a handle shank-lock, the handle shank-lock located proximate to the butt-end of the hammer-handle, and the handle shank-lock operable to lock the shank of the auxiliary tool inserted through the handle receiver into the shank-way of the multi-tooled hammer.

4. A multi-tooled hammer apparatus comprising:

a base-hammer having a hammer-head attached to a hammer-handle, the hammer-head including a top-end and the hammer-handle including a butt-end, and the base-hammer including a shank-way, the shank-way defining an internal passage within the base-hammer, from the top end of the hammer-head to the butt-end of the hammer-handle;

an auxiliary tool mountable to the base-hammer, the auxiliary tool having a tool-head and a tool-shank, the tool-shank receivable into the shank-way of the base hammer;

the tool-head augmented by the hammer-head in a task performed by the multi-tooled hammer apparatus;

a shank-lock, the shank-lock operable to lock the shank within the shank-way of the multi-tooled hammer, and a handle receiver included proximate to the top-end of the hammer-head, the tool-shank of the auxiliary tool insertable into the shank-head receiver at the head receiver.

5. A multi-tooled hammer apparatus comprising:

a base-hammer having a hammer-head attached to a hammer-handle, the hammer-head including a top-end and the hammer-handle including a butt-end, and the base-hammer including a shank-way within the base-hammer, the shank-way defining an internal passage within the base-hammer;

an auxiliary tool mountable to the base-hammer, the auxiliary tool having a tool-head and a tool-shank, the tool-shank receivable into the shank-way of the base hammer;

a shank-lock on the shank-way, the shank-lock operable to lock the shank within the shank-way of the multi-tooled hammer;

a head receiver is included proximate to the top-end of the hammer-head, the tool-shank of the auxiliary tool inserted into the shank-way at the head receiver; and the shank-lock is a head shank-lock, the hammer head having a base end opposite the top end of the hammer head, the head shank-lock located proximate to the base-end of the hammer-head and the head shank-lock operable to lock the shank of the auxiliary tool inserted through the head receiver into the shank-way of the multi-tooled hammer.

6. The multi-tooled hammer apparatus of claim 5, wherein:

a handle receiver is included in the base-hammer proximate to the butt-end of the base-hammer, and the tool-shank of the auxiliary tool inserted into the shank-way at the handle receiver.

7. The multi-tooled hammer apparatus of claim 5, wherein:

the shank-lock is a handle shank-lock, the handle shank-lock located proximate to the butt-end of the hammer-handle, and the handle shank-lock operable to lock the shank of the auxiliary tool inserted through the handle receiver into the shank-way of the multi-tooled hammer.

* * * * *